United States Patent [19]

Franz

[11] 4,300,512

[45] Nov. 17, 1981

[54] MHD ENGINE

[76] Inventor: Dennis L. Franz, Rte. #1, Box 1198-B, Selah, Wash. 98942

[21] Appl. No.: 17,258

[22] Filed: Mar. 5, 1979

[51] Int. Cl.[3] ..... F02B 75/02

[52] U.S. Cl. ..... 123/536; 123/64

[58] Field of Search ..... 123/64, 51 AA, 51 R, 123/75 B, 2, 568, 536, 1 R, 193 C, 193 CP, 41.84, 80 BB, 59 EC; 290/1 R; 60/272, 275, 278; 310/11

[56] References Cited

U.S. PATENT DOCUMENTS

| | | | |
|---|---|---|---|
| 3,621,310 | 11/1971 | Takeuchi et al. | 310/11 |
| 3,660,700 | 5/1972 | Aisenberg et al. | 310/11 |
| 4,037,572 | 7/1977 | Franz | 123/64 |
| 4,097,752 | 6/1978 | Wulf et al. | 290/1 R X |
| 4,213,428 | 7/1980 | Bradley | 123/1 R |

*Primary Examiner*—Harry N. Haroian

[57] ABSTRACT

A magnetohydrodynamic generator feeds electrical energy to a six cycle internal combustion engine having pairs of opposed pistons in each cylinder and a three port rotary valve system. A first exhaust port leads the partially combusted gases from one cylinder to the next and a second exhaust port leads the ionized, fully combusted gases to the magnetohydrodynamic generator, where the ionized exhaust gases pass through cryogenic, super-cooled magnetic fields, towards an electron emitter at the output end of the magnetohydrodynamic generator.

The passage of the ionized gases through the magnetic fields produces current which is conducted to electrodes on opposed piston faces and to coils in the cylinder walls. The stream of electrodes between opposed piston faces and the coil in the cylinder sets up magnetic fields in the cylinders which isolate the combustion gases from the wall surface of the cylinder. The current produced in the magnetohydrodynamic generator is also conducted to a coil in the head of the piston which sets up a positive charge on the piston face which gathers electrons from the combusted gases in the cylinder and conducts them to the emitter in the magnetohydrodynamic generator.

Control of the magnetic fields is accomplished through a rotary disk having arc-shaped means of magnets or slots, which create electrical energy as they pass adjacent a sensing device of a coil sensor or a photo cell, respectively.

35 Claims, 21 Drawing Figures

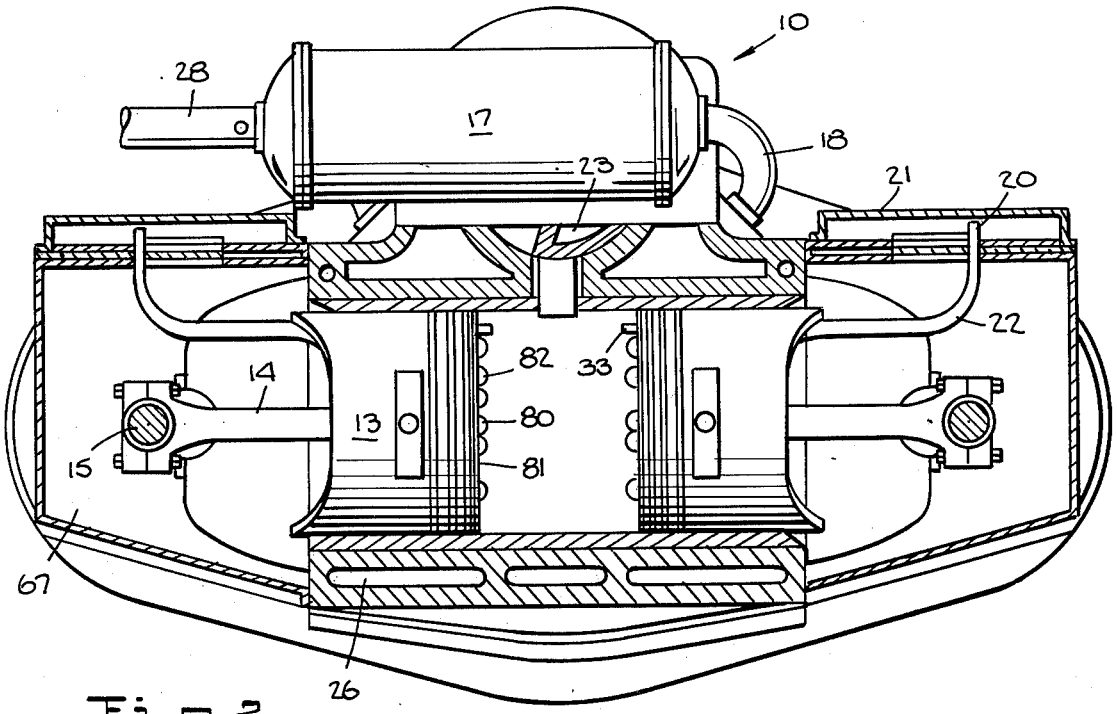
Fig. 2.
Fig. 4.
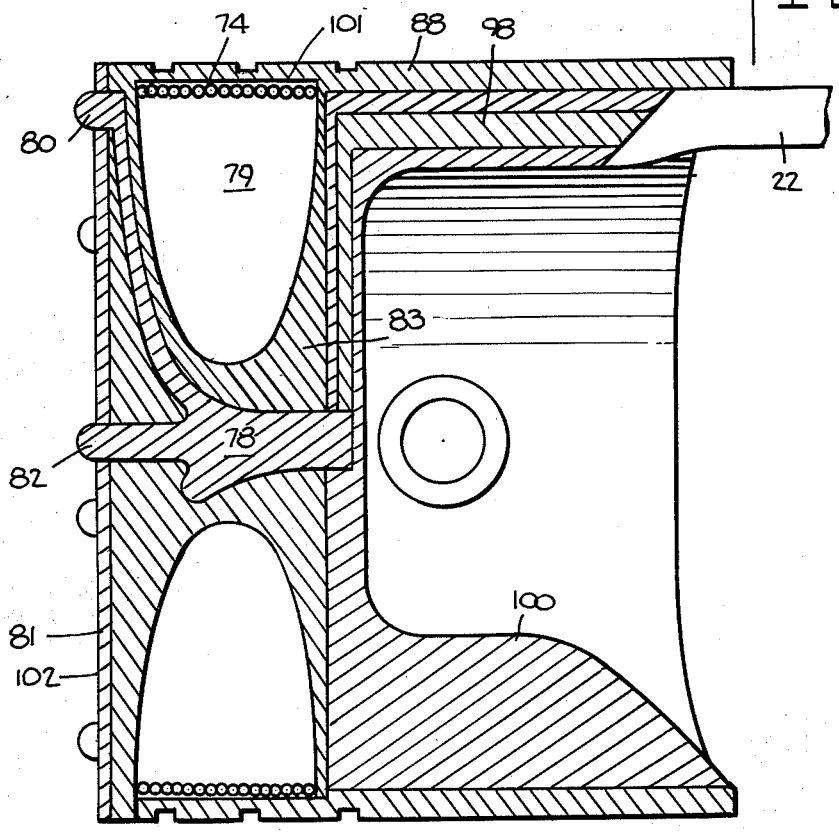

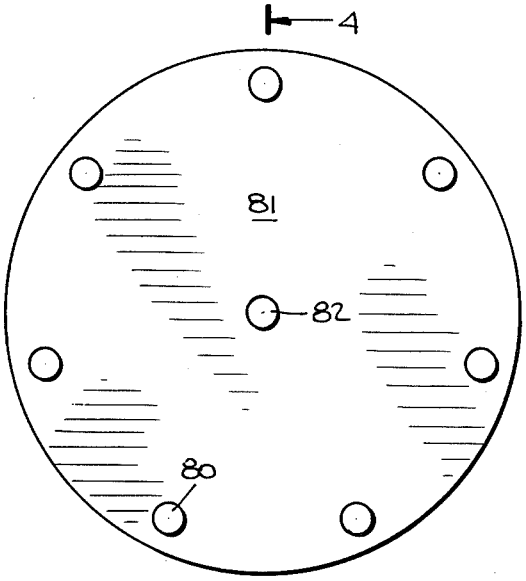
Fig. 3.
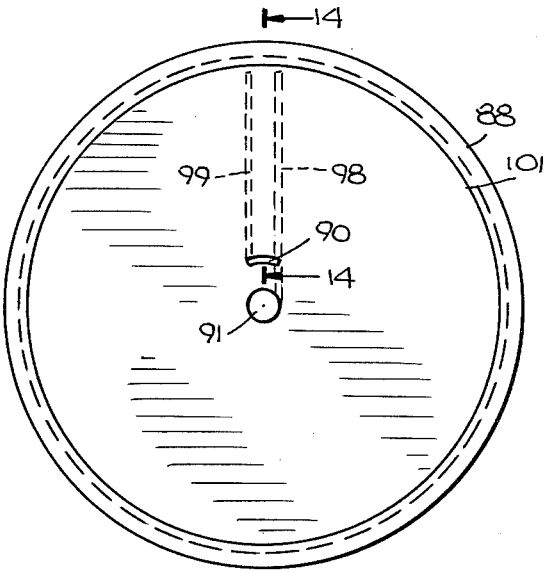
Fig. 13.
Fig. 21.
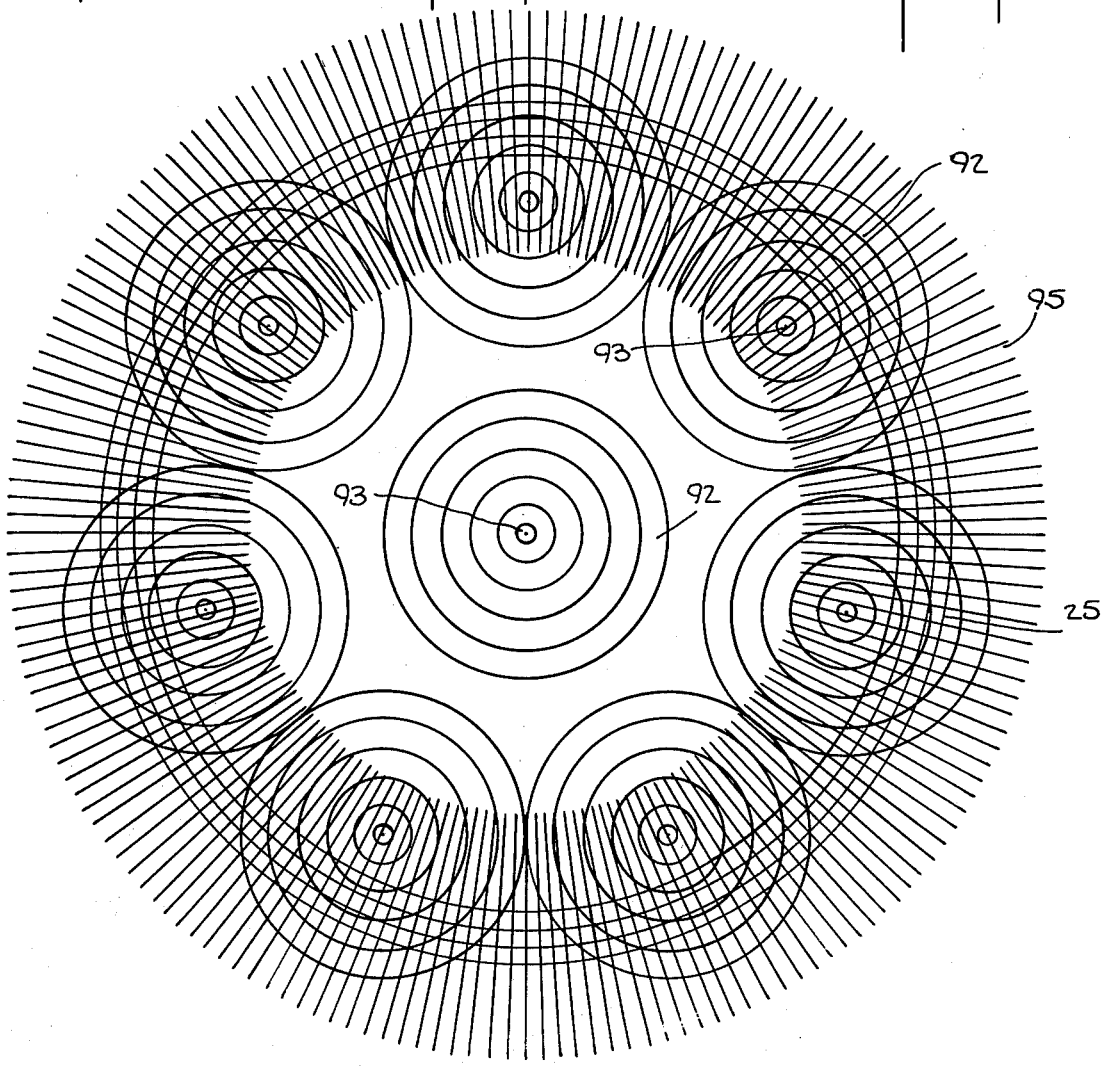

1 - Intake
2 - Primary Compression
3 - Primary Combustion
4 - Secondary Compression
5 - Secondary Combustion
6 - Secondary Exhaust
27
30
29

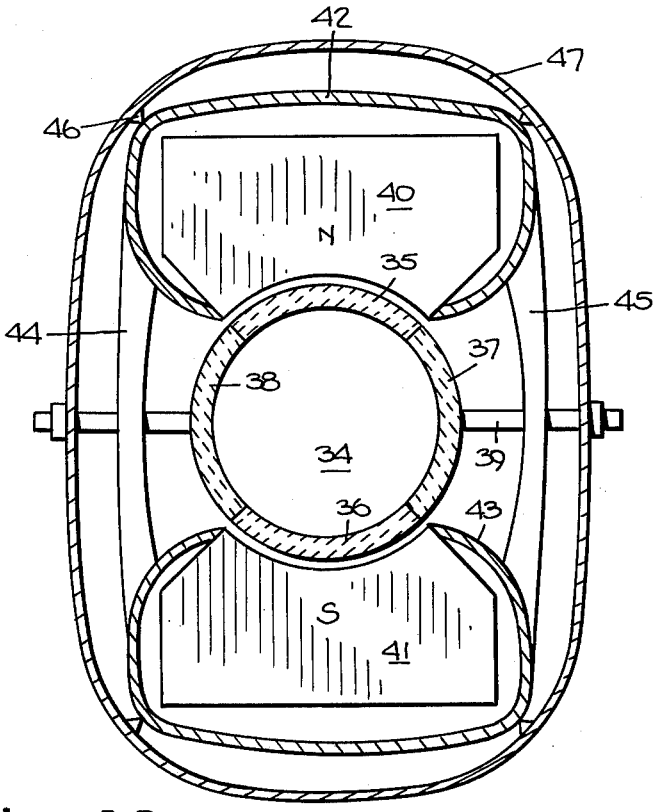
Fig. 10.
Fig. 15.
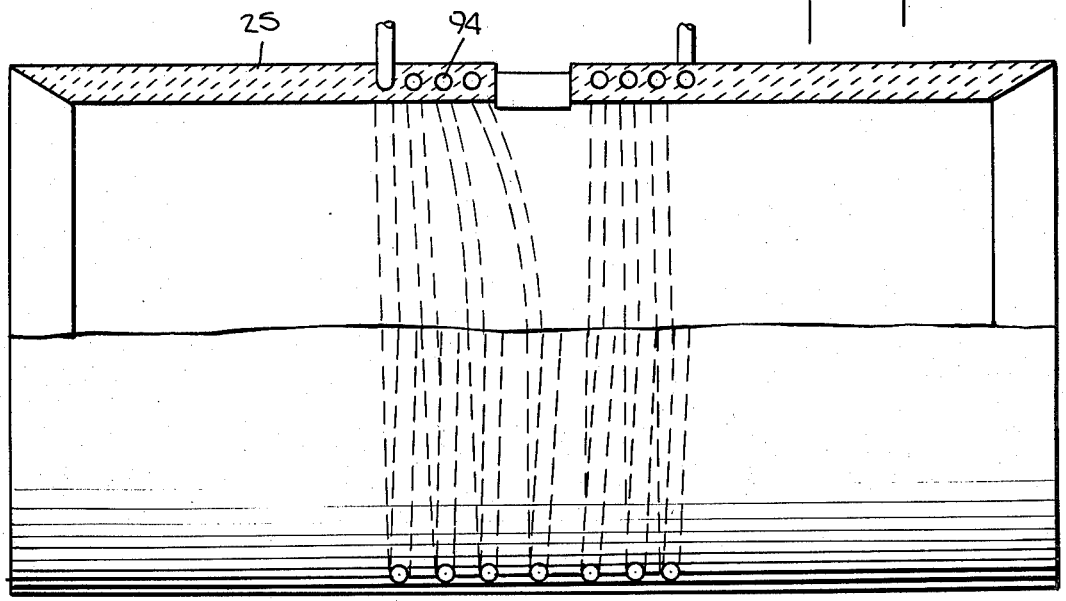

Fig. 11.
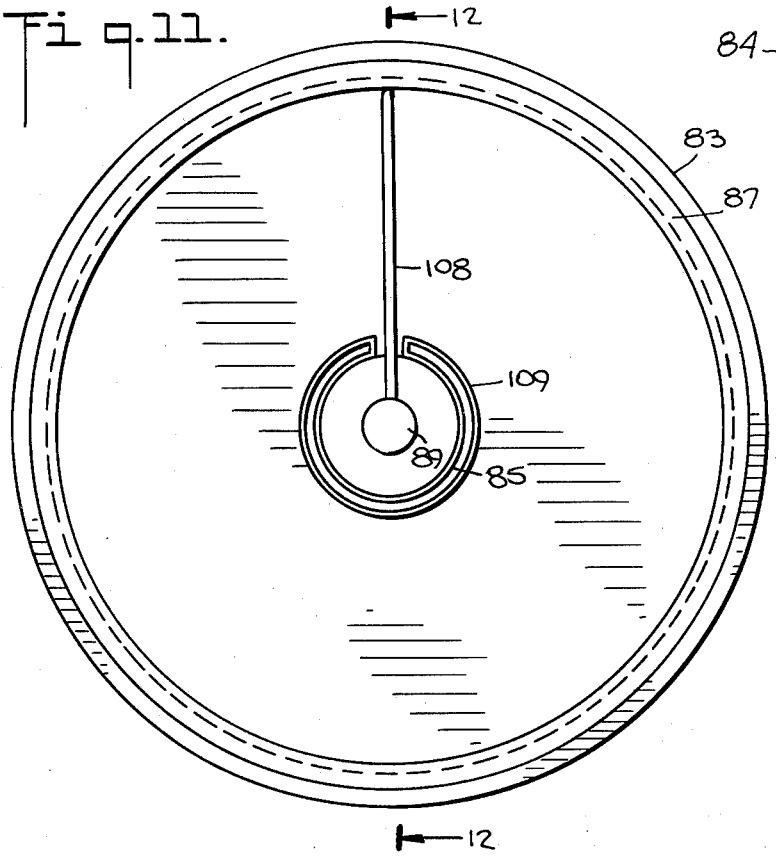
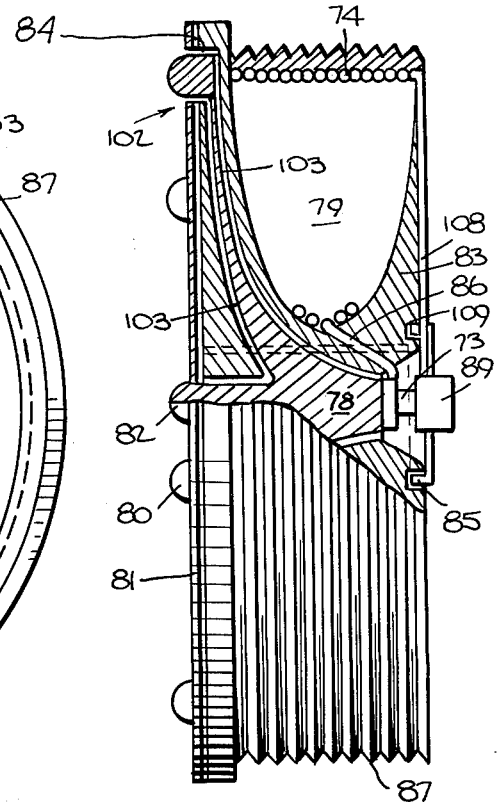
Fig. 12.
Fig. 16.
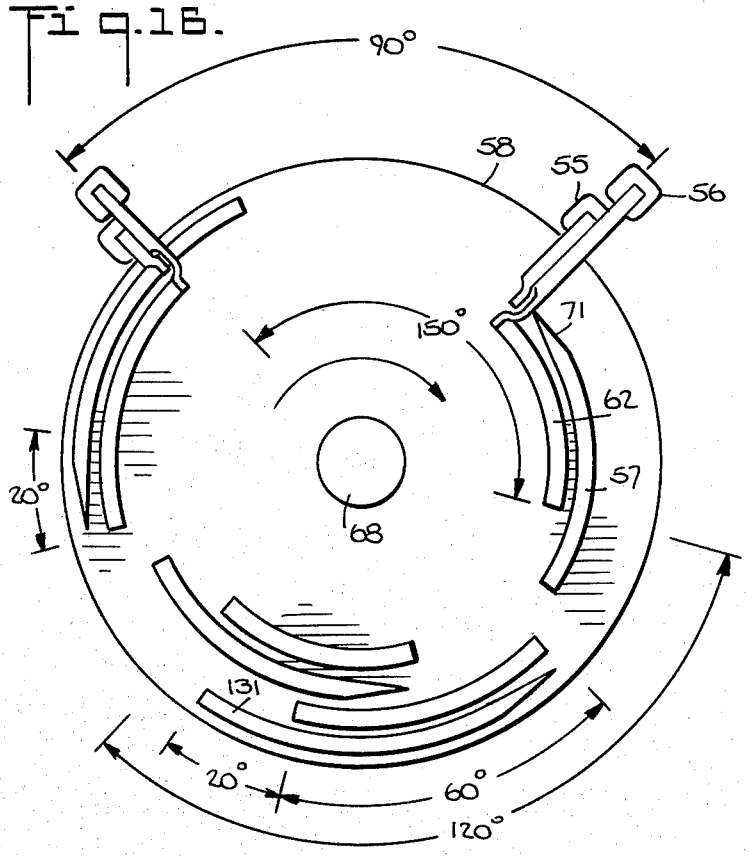
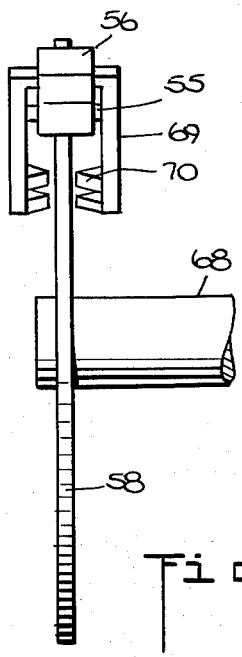
Fig. 17.

MHD ENGINE

This invention relates to an internal combustion engine and more particularly to an engine which combines the advantages of magnetohydrodynamics and six cycle rotary valve engines. The latter were shown and described in U.S. Pat. No. 3,392,220 dated July 1, 1975 and U.S. Pat. No. 4,037,572 dated July 26, 1977 of the same inventor.

BACKGROUND OF THE INVENTION

New engine adaptations and designs are being studied and developed to attempt to improve the traditional combustion process, mainly the four stroke combustion system. Some examples of the adaptations are revisions in carburation techniques, fuel consumption monitoring, alterations in combustion chamber aerodynamics, basic engine configurations such as the rotary engine, vaporization and ionization of fuel for more complete combustion, new exotic fuels, and other processes. While these are all worthwhile endeavors and knowledge is gained through these efforts, the basic problems are not solved and the basic variables of these engines' operation are not fully coordinated.

In all engines there are four fundamental variables that must be worked with in various ways so they complement each other to produce desirable results. These variables are *time* and *temperature* of combustion, *density* of the gas and *area* of the combustion chamber. The desirable results are complete combustion with a relatively low exhaust temperature. Density is the easiest variable to manipulate through adjustments in liquid flow. The other three are more difficult.

At a given temperature there must be sufficient time to complete combustion. The lower the temperature the longer the time for complete oxidation. The higher the temperature the shorter the time for oxidation. This temperature variable has certain upper and lower limits. A temperature of 3200 degrees C. appears to be the upper limit of combustion without $NO_2$ formation in an unrestricted environment, and 5500 degrees C. is the highest temperature achievable by a chemical reaction.

A measure of efficiency of an engine is the relationship between the highest temperature allowed minus the output temperature of exhaust divided by the first temperature. Therefore it is impossible here on earth to get an absolutely efficient temperature relationship because the exhaust temperature can never be below outside air temperature. To be at top efficiency the exhaust temperature would have to be absolute zero. The six cycle configuration takes care of these temperature limitations.

Temperature also has a relationship with pressure. This relationship is dependent on the density of the gas involved; temperature being a measure of the average kinetic energy of the gas. A gas with low density can have molecules with very high velocity and still have low pressure, but this same gas with high density and the same velocity would have high pressure and a high temperature. The average kinetic energies of the high and low density examples are the same; only their densities and pressures have changed. These variables can be switched around to achieve similar results along different paths.

The time of combustion is just as critical as temperature to achieve the desirable result of total oxidation and extraction of energy from a given unit of fuel. Given the limits of temperature there is just not enough time in present engine designs to give complete oxidation no matter what the mixture setting. The time to oxidation ratio gets even worse as increases of throttle and power settings are offset by higher rpm's due to the relatively unchanging size of the combustion chamber. It may be somewhat better under load conditions.

A continuous time of oxidation is probably ideal, such as presented in steam and turbine engines, but they have problems with the other variables, e.g. area and heat transfer, density and disassociation. They also have mechanical limitations of valving, power strokes related to rmp, heat resistent materials, and lubrication breakdown at extreme temperatures and exposure to the products of combustion (silicone based oils). The variable of time is also handled by the six cycle configuration.

Increasing the amount of time in a combustion chamber involves increasing the surface area of the chamber. The ratio of volume to area in a sphere or even a cylinder is a disproportionate one. Increasing the volume of space enclosed by a sphere or cylinder by a unit does not increase the surface area of that enclosure by the same unit, but by a fraction of a unit. Any surface area is detrimental to some extent. The kinetic energy of the molecules is diminished when they touch this surface.

When time is increased, oxidation is enhanced, but surface area is increased and heat loss is increased. This is at the heart of the problems involved in engine designs, internal and external. The question is "How are the fuel, oxygen and combustion products, and their kinetic energy and velocity separated from the surface area of the combustion chamber?" "How are they to be insulated inside the chamber?"

OBJECTS AND STATEMENT OF THE INVENTION

These questions are answered by the improvements of the present invention, which cause flows of electrons to pass through the gas in the chamber in special configurations. These electrons will break loose electrons in the gas, giving these molecules a positive charge and creating a gas that can carry electric currents. These flows of electrons then have their own magnetic fields, which surround the gas and insulate it from the containing surface area. Combustion further ionizes the gas, reducing the resistance to the electron flow. The resulting magnetic field effects all the variables of time, temperature, area and disassociation (density). The exhaust gases are also ionized and provide the means to generate the necessary amounts of electricity to energize the combustion chamber gases. A balance is reached between cost of energy to produce the electron flow through the MHD generator and the benefit the magnetic fields produce through energy saving in stopping heat transfer to the surface area of the combustion chamber.

The application of magnetohydrodynamics (MHD) to the internal combustion engine as above described is new and advantageous.

The principles of magnetohydrodynamics working on the variables of area and temperature and the six cycle configuration working on the variables of time and temperature provide a truly unique engine.

The engine is very small, extremely light, has an exceptionally good fuel efficiency, is pollution free and, with optimum results, would have no water jacket and still be cool to the touch, with a cool exhaust.

BRIEF DESCRIPTION OF THE FIGS.

These and other advantages of the present invention will be more fully understood in the following detailed description, taken together with the drawings in which FIG. 1 is a top view of the engine in accordance with the invention, shown in partial section.

FIG. 2 is a front view of the engine, shown in partial section.

FIG. 3 is a plan view of the piston face, showing the array of electrodes.

FIG. 4 is a side sectional view of the piston, taken along the lines 4—4 in FIG. 3.

FIG. 10 is a sectional view of the magnetohydrodynamic generator, taken along lines 10—10 in FIG. 9.

FIG. 11 is an end view of the piston magnet.

FIG. 12 is a sectional view of the piston magnet, taken along lines 12—12 of FIG. 11.

FIG. 13 is an end view of the piston with the piston magnet removed, showing the piston arm, contacts and side buses.

FIG. 15 is a side view of the cylinder lining and its embedded coil, shown in partial section.

FIG. 16 is a side view of the timing disk with associated magnets and pickup coils.

FIG. 17 is an end view of the timing disk with associated magnets and pickup coils.

FIG. 21 is a representation of the longitudinal magnetic fields, as seen looking through the cylinders.

DETAILED DESCRIPTION OF THE INVENTION

Figure 1:
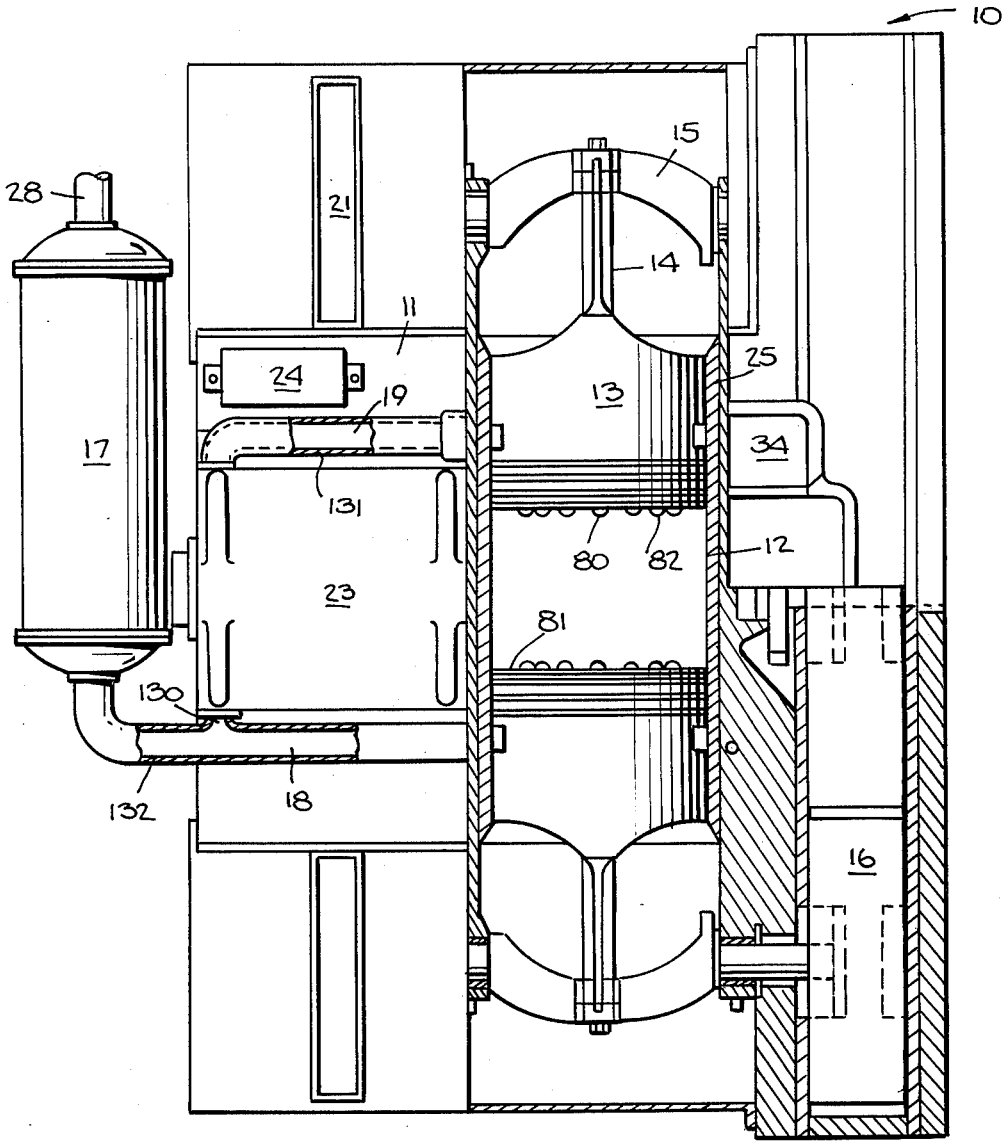
Figure 14:
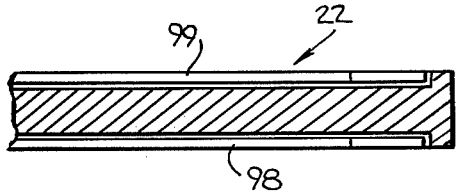
FIG. 14 is a sectional view of the piston arm, taken along the lines 14—14 in FIG. 13.
Figure 5:
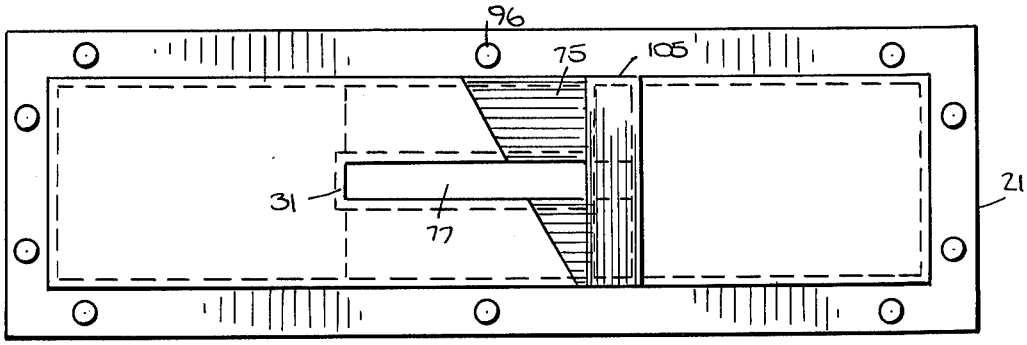
FIG. 5 is a plan view of the commutator.
Figure 6:
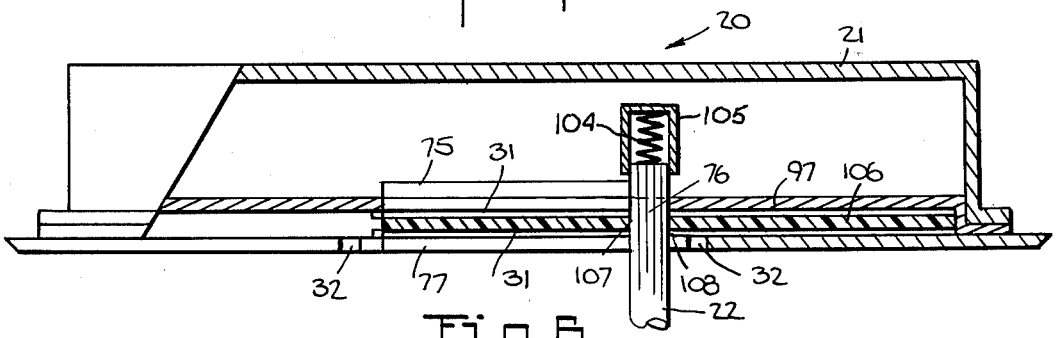
FIG. 6 is a side view of the commutator, shown in partial section.

Referring to FIGS. 1-6, the engine according to this invention is shown generally as 10. The engine comprises a block 11 having two cylinders 12, each having a pair of opposed pistons 13, connected by connecting rods 14 and cranks 15 to gears 16. A magnetohydrodynamic generator 17 is secured at one side of the engine 10 and is connected to the secondary exhaust manifold 18 of the engine. The primary exhaust/intake manifold 19 of one cylinder is arranged to input with the next cylinder. The primary exhause/intake manifold 19 has a glass dielectric lining 131. Similarly the secondary exhaust manifold 18 has a glass dielectric lining 132. A commutator 20 within a commutator cover 21 is connected by an arm 22 to each piston 13. An exhaust pipe 28 leads from the generator 17 to the outside air.

Mounted above the block 11 centrally over the cylinders 12, are rotary valves 23, the purpose and functions of which are described in my earlier U.S. Pat. No. 4,037,572, dated July 26, 1977. A control center 24, to be more fully described, is also mounted over the block 11 and is associated with each cylinder 12.

Each cylinder has a nonconducting glass lining 25.

The block 11 is shown with a coolant jacket 26. If some heat is transferred to the cylinder walls 25, a coolant jacket 26 will remove this heat. If the magnetic fields are generated so that heat is not transferred to the cylinder walls, no coolant is needed. Then there would be no need for the radiator, coolant pump, thermostat, hoses, or fan and their accompanying energy drain and oil would be directed through the rotary valve 23.

Each crankcase has provision for commutators 20 which are mounted on their respective crankcase 67. A slot 77 for the intrusion of the piston arm 22 is placed on the crankcase. Surrounding this slot 77 are seals 31 to prevent oil from entering the area above the slot. These seals press against the slide to be described. On either end of the slots 77 and seals 31 are oil drain holes 32 which provide a means for any oil that gets past the seals 32 to return to the crankcase 67. Of course as in all engines this crankcase is vented. In addition to its own mounting holes each crankcase has mounting holes 96 for the slide cover 97 and unit cover 21.

Each piston 13 contains an arm 22. The purpose of this arm 22 is to connect the piston electrically to the engine. It contains two insulated buses 98, 99 that connect the brushes 76 to the piston electromagnet 79, electrodes 80, 82 (bus 98), and piston face 81 (bus 99). It is permanently attached to or cast with the piston body 88 itself.

The piston body 88 also has a weight or mass 100 cast with it to balance the moment of the arm 22. The mass 100 is placed opposite of the arm on the piston body 88.

The piston body 88 also has its front inner surface 101 threaded to receive the piston face unit 102. The piston without this unit is essentially a hollow tube threaded on the inside at one end and containing the piston arm 22 and moment mass 100 on the other.

The piston face unit 102 is threaded on its outside surface to match the threads on the piston body 88 and has face 81 on its front, an electron conducting metal. This lining face 81 has protruding from it in a circle and at the center, the surfaces of the electrodes 80, 82.

The electrodes 80, 82 are a part of the electromagnet's core 83 but insulated from it by insulation 103 and are all connected to the center of the core 78 where they come in contact with the arm bus 22. The shape of these electrode ends is a dome as it protrudes from the face lining 81.

Another part of the face unit 102 is the electromagnet 79. The core 83 of the electromagnet 79 contains the insulated electrodes 80, 82 and is made of iron. The energizing means of this magnet is the standard copper coil 74. This wire coil is wrapped around the central core 83 of iron and in the correct direction so that the positive charge of the magnet faces the combustion chamber.

The commutator 20 solves the problem of transferring electricity to and from the pistons 13 without interference from engine oil. The pistons 13, connecting rods 14, and crankshaft 15 are essentially free floating on an oil film and constant metal electrical contact needed is not present. Also an oil film serves as an electron insulation.

The piston arm 22 is inserted through the crankcase slot 77. There are two electroplates 75 on either side of the arm 22 and are connected to the top of the slide cover 97. These plates 75 have their cover 21 that encloses the whole unit.

The brushes 76 slide on these electroplates 75, one brush for one plate, and are attached to the piston arm 22. These brushes 76 are electrically connected to their respective bus 98, 99 in the arm 22 and are under tension, pressing on the plates. This tension is provided by springs 104 placed above the brushes and under the brush cover 105 which is attached with screws to the piston arm 22. These springs 104 provide pressure to the plates 75 as well as compensate for small variations in vertical movement in the arm due to piston jar in the cylinders. This is very small in the piston itself but amplified through the arm 22 because of its length.

The slide cover 97 is below the electroplates 75 and has a slot 77 through which the piston arm 22 passes. This cover has seals 31 around the slot 77 on the bottom side and is mounted to the crankcase 67.

A slide 106 is located under this cover 97 and moves back and forth between the seals 31 on the slide cover 97 and the seals 31 on the crankcase 67. In the center of the slide 106 is a hole 107 through which the piston arm 22 passes and this hole is rubber lined 108 to seal any oil from passing. This slide 106 moves back and forth with the piston arm 22 preventing oil from passing from the crankcase slot onto the electroplates 75 and brushes 76.

Figure 8:
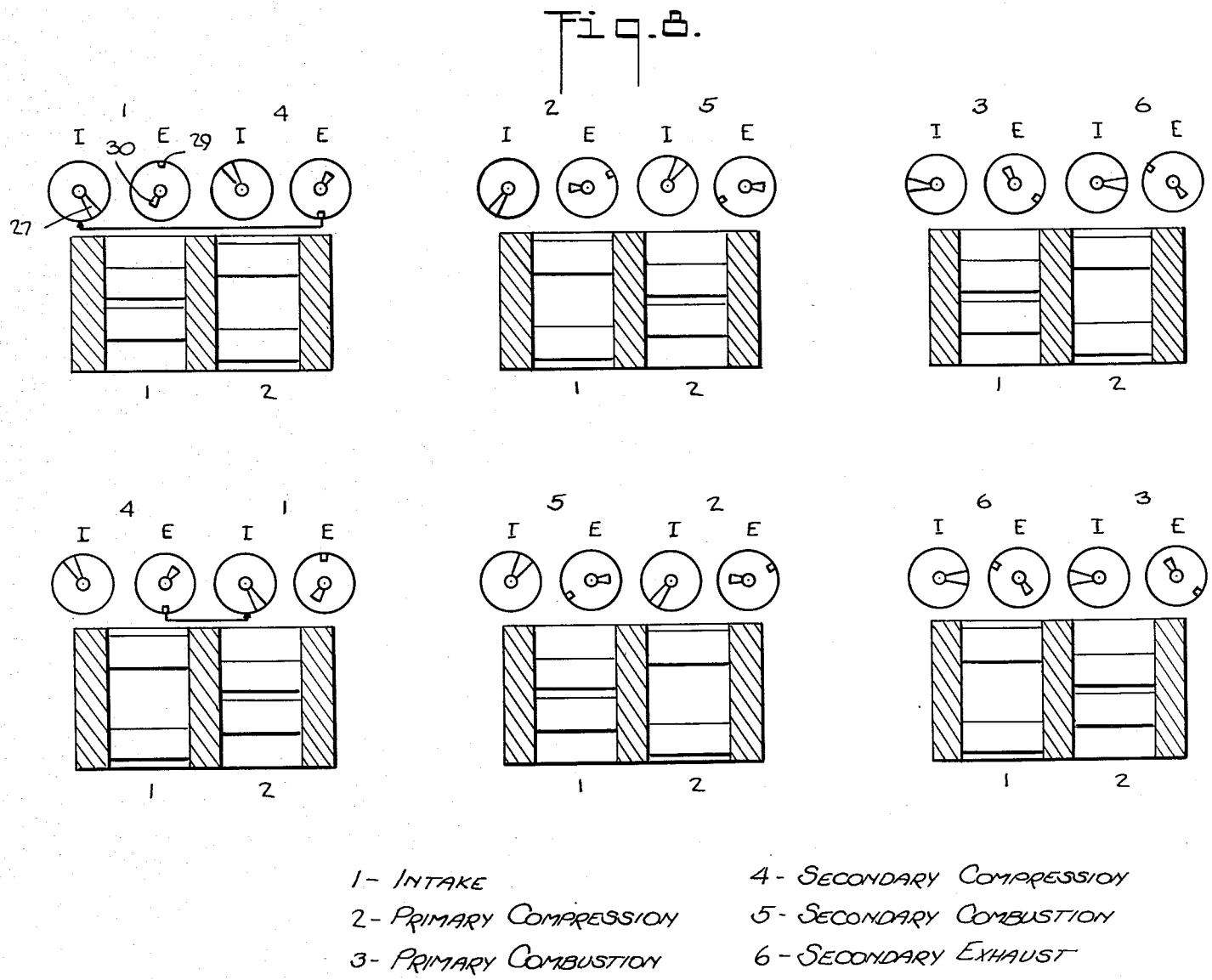
FIG. 8 is a schematic of the six cycles of the engine, showing concurrent piston and valve positions and emphasizing the relationship between the intake port and the primary exhaust port.

The fuel system and sequences will be described with particular reference to FIG. 8.

The fuel can arrive from the storage tank in two ways (not shown). The first is by the standard line and fuel pump. The second method, assuming a liquid such as gasoline or diesel is used, is to use a vacuum pump and reduce atmospheric pressure in the storage tank to the point of boiling the fuel in the tank at outside air temperature. Either the fuel pump or the vacuum pump then transfers the fuel in whatever state to the metering device which meters the fuel to the engine.

There are several metering devices and varying types of each device. These devices include carburetors, injectors and gas meters. Although these attachments are necessary to this engine, it is not of significance which device is selected because they deal mainly in the variable density and the six cycle configuration allows time for low grade fuel and unburned fuel to be refined and completely burned. The fuel is then burned in the oxidation sequence.

Each rotary valve 23 has an intake port 27 on one side, which connects the cylinder 12 to the intake manifold 19 during the intake cycle, and a primary exhaust port 29, and a secondary exhaust port 30 on the other side, which connects the cylinders 12 to the primary exhaust/intake manifold 19 and the exhaust manifold 18, respectively, during appropriate cycles of the six cycle process. Primary exhaust is partially ionized and very dirty and is directed through the primary exhaust port 24 through its own passage 129 in the engine to the primary exhaust/intake manifold 19. The primary exhaust/intake manifold always has a few pounds of vacuum negative pressure and primary exhaust has opposite pressure so flow will readily exist. The vast majority of molecules that end up in primary exhaust go through the combustion process three times. First, in primary combustion in cylinder 1, then transferred over to cylinder 2 in intake and combusted again in the second cylinder's primary combustion, then combusted again in the second cylinder's secondary combustion, before it is exhausted through exhaust passage 130 in the engine into and through the secondary exhaust manifold 18.

Primary exhaust serves two purposes for combustion. It releaves pressure at the end of primary combustion. This further cools the combustion gases and partially removes incomplete combusted products to the point that temperature and density of fuel are below the ignition requirements when the turbine injects fresh oxygen preparing for secondary combustion.

Since primary exhaust is ionized it further serves an electrical function in that it allows energy to be saved in primary combustion. The electrons flowing between the pistons 13 can more easily find their way and further the magnetic task. This helps divide the energy produced by the magnetohydrodynamic generator 17 operating only on secondary exhaust, between primary and secondary combustion. The glass dielectric lining 132 on the secondary exhaust manifold 18 prevents errant electrons from dionizing secondary exhaust gas, which would have a negative effect on the function of the engine. The glass dielectric lining 131 on the primary exhaust/intake manifold 19 prevents dionizing of the primary exhaust. The six stages shown in FIG. 8 for each position of the rotary valves are at the beginning of the piston stroke.

As the pistons 13 move apart in the intake stroke (stage 1 for cylinder 1) air enters the chamber 12 through the intake port 27 along with partially burned and partially ionized fuel from the primary exhaust through the primary exhaust port 29 in the accompanying cylinder 2. As the pistons 13 approach the end of this stroke a small amount of air enters the chamber through the side ports 33 in the cylinder supplied by a turbo-charger 34. If a carburetor or gas meter is used the fuel charge will also have entered through the intake port 27 at this time.

The primary compression stroke (stage 2 for cylinder 1) then begins. The pistons come together and compress this mixture of gases that already have a small amount of ionization from the primary exhaust gases included.

Primary power stroke (stage 3 for cylinder 1) then begins. At this point the electrodes 80, 82 are energized and electrons begin beaming from one electrode to its mate in the opposite piston which are almost touching. Also if the engine is injected, the fuel will be forced into the chamber at this time. As the electrons begin to beam across, they ignite the fuel air mixture. Ionization begins to develop rapidly as electrons are bumped off their atoms by the beam of electrons coming from the electrodes and by the force of the oxidation process itself. As this process begins the combustion gases become charged with a positive sign since electrons are negative. Also at this point electromagnets in the pistons 13 (to be more fully described) are energized with the positive side of the magnet facing the combustion chamber repelling the positively charged gases from the piston faces, creating force. Finally at this point a magnetic field begins to surround the combustion gases preventing them from touching the surface of the cylinder 12 and transfering their kinetic energy to the cylinder. The gases are contained, with the pistons 13 being forced apart ideally only through magnetic force working against expanding gases.

As the burning progresses the beam of electrons continues and becomes stronger as more ionization occurs, making a better conductor. Then as the pistons 13 reach their extended position and the port 33 for the incoming air opens, with the turbo blocked off because of the cylinder pressure, the electric current or beam of electrons is reduced by a rheostat (to be more fully described) and the magnetic field strength balanced with the expanding and cooling gases of primary combustion. At this point the primary exhaust port 29 begins to open, further reducing pressure in the cylinder 12 and allowing fresh air from the turbo to enter the chamber. At this point the fire in the cylinder 12 is put out because of insufficient heat to maintain combustion. Finally at full extension of the pistons the current is turned off.

Secondary compression then begins (stage 4 of cylinder 1). During this stroke the electrodes are turned off.

The secondary power stroke (stage 5 of cylinder 1) now begins with the same electrical functions used in the primary power stroke. The exhaust stroke (stage 6 of cylinder 1) then finishes the oxidation sequence.

The engine turbine 34 is geared to a timing gear on the shaft of the rotary valve 23. It provides fresh air to the cylinder through the cylinder ports or slots 33 at a low pressure. It does not force air into the chamber but only makes air available to the chamber when it is ready to accept it. These times are at the end of the intake stroke (stage 1) and the beginning of the secondary compression stroke (stage 4).

Even though the cylinder port 33 is opened by the piston 13 by its position at the beginning of the primary compression stroke the turbine 34 will not be providing air at this time because the pressure in the cylinder 12 will have equalized between the cylinder 12 and the turbine 34. Therefore, air is only being introduced at the end of the intake stroke when the pressure in the cylinder 12 is less than that produced by the turbine 34 no matter what the rpm.

The same holds true at the end of the primary combustion (power) stroke and the beginning of the secondary compression stroke. At the end of primary combustion when the side ports 33 start to open there is pressure in the cylinder 12, much reduced now as compared to the beginning of the stroke, and this pressure prevents air from entering the cylinder. A little later the primary exhaust port 29 begins to open reducing pressure in the cylinder 12 to the point of allowing the turbine pressure to insert fresh air into the cylinder.

Under load conditions where cylinder pressure is not matched by equal increase in rpm, the pressure produced by the turbine 34 must increase. This is done by the standard waste gate linked to the throttle as used in most turbo-chargers.

Figure 7:
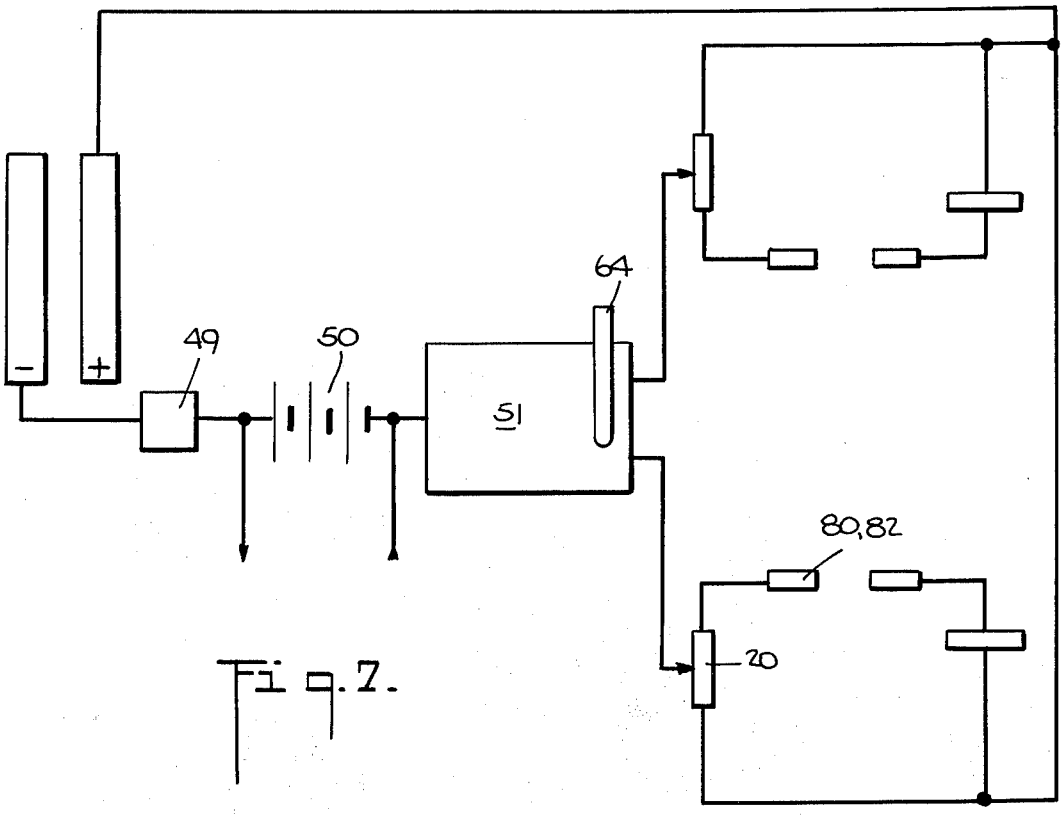
FIG. 7 is a schematic diagram of the overall electrical system.
Figure 9:
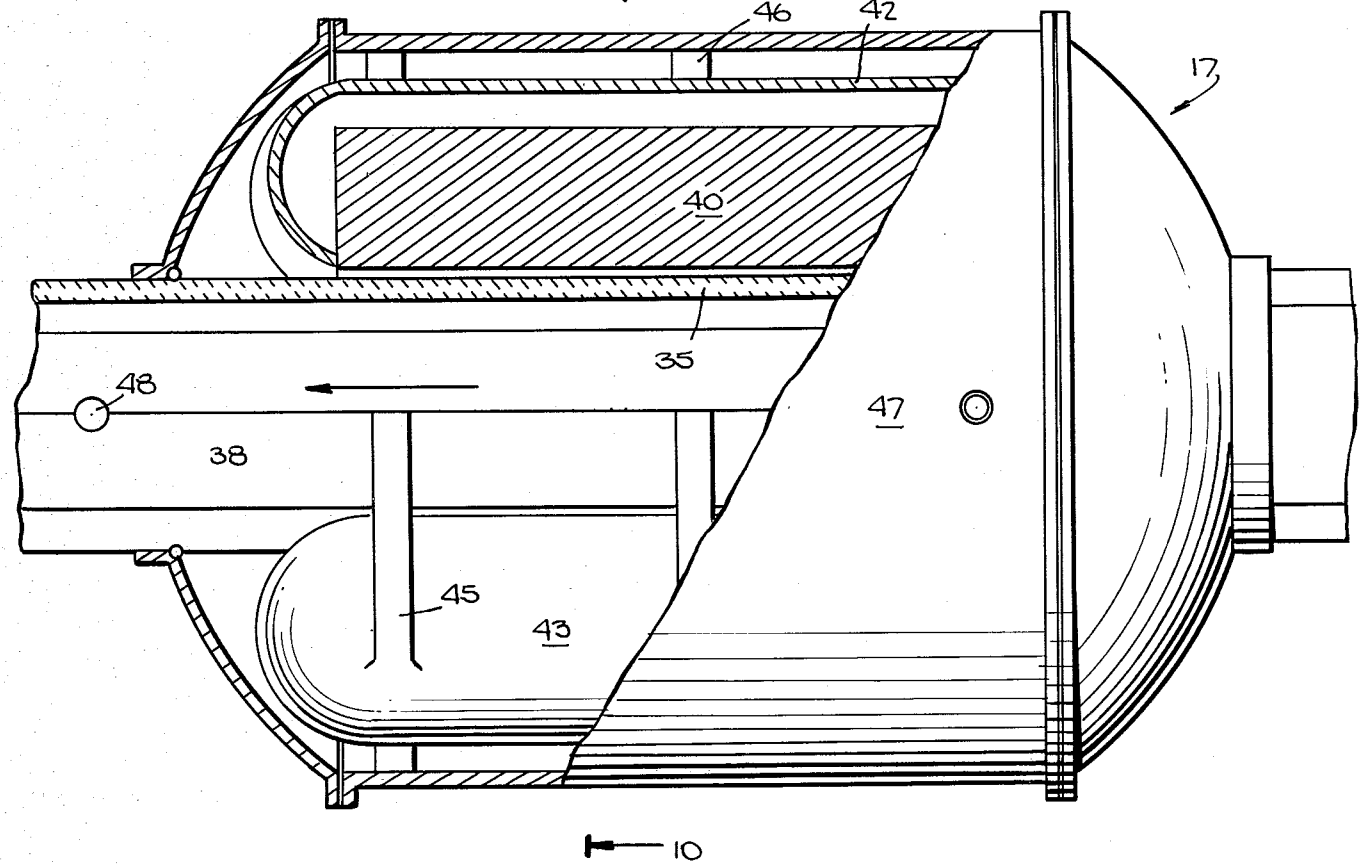
FIG. 9 is a side view of the magnetohydrodynamic generator, shown in partial section.

The electrical system is next with reference to FIGS. 7, 9 and 10 described. The electricity used in this engine is produced and used by units which are dependent on each other for their electrical function. It is a balanced system with a circular interaction. Therefore a beginning is really not the beginning but a point chosen for beginning. A point to start is the magnetohydrodynamic (MHD) generator 17. The electrons are set in motion here by the magnetic field produced by stationary magnets acting upon the moving ionized gas in the exhaust.

A MHD generator produces movement of electrons (electricity) by passing a magnetic field at a right angle through a moving ionized gas. The generator as shown has several features for efficient electrical production. The first feature is the ionized gas container 34.

This is a pipe, which comes from the glass lined exhaust manifold, has four sections running the length of the generator. The top and bottom sections 35, 36 are glass and nonconductive. The sides of the pipe 34 are actually electrical plates 37, 38 with electrical leads 39 attached. These plates are placed at right angles to the magnetic flow and expel and receive the electrons acted upon by the magnetic flow. This pipe does not touch anything inside the generator 17 and is surrounded by a vacuum to prevent the heat inside it from traveling to the other parts of the generator. The pipe is held in place by the outside container of the generator.

Generator magnets 40, 41 are placed above and below this center pipe 34 and are inside cryogen tanks 42, 43 which also support them. The magnets 40, 41 are super cooled by the cryogen in the tanks 42, 43. The purpose of cooling the magnets to a few degrees above absolute zero is to make them efficient and their produced magnetic field effective in relation to their size and weight. The cryogen surrounding the magnets could be either liquid oxygen or liquid nitrogen.

The cryogen tanks 42, 43 are sealed to the magnets 40, 41 and held in place relative to each other by supports 44, 45 attached to them. These supports must not only be strong enough to handle the weight of the magnets, 40, 41 cryogen, and tanks 42, 43 but also strong enough to handle the strong magnetic attraction between the magnets. The cryogen tanks 42, 43 with their respective magnets 40, 41 inside being held together with the supports 44, 45 then becomes a unit which is placed inside another tank 47.

This unit is held inside the tank 47 by supports 46 that are of a wedge in shape with the pointed side next to the unit. The purpose of the wedge and point is to expose the least amount of surface area between the cryogen tanks 42, 43 and the outer tank 47 to prevent flow of kinetic energy from the outer tank 47 to the cryogen tanks 42, 43. This flow of energy must be minimized to prevent the warming of the cryogen in the tanks 42, 43.

This insulating is also the purpose of the outer tank 47 and the inner vacuum that it holds. The vacuum inside this outside tank 47 keeps the cryogen tanks 42, 43 and magnets 40, 41 cold and prevents transfer of energy from the inside pipe 34 and the outside air to the magnets 40, 41

At the far end of the generator 17 is an electron emitter 48 which gives and directs electrons to the inside positively charged gas. These electrons come from the piston faces, dealt with later. This emitter 48 is so positioned to help pull the ionized gas through the generator 17 as well as help give a positive charge to the piston faces. The position is also important in this respect because of the relative low temperature of the ionized gas.

Figure 20:
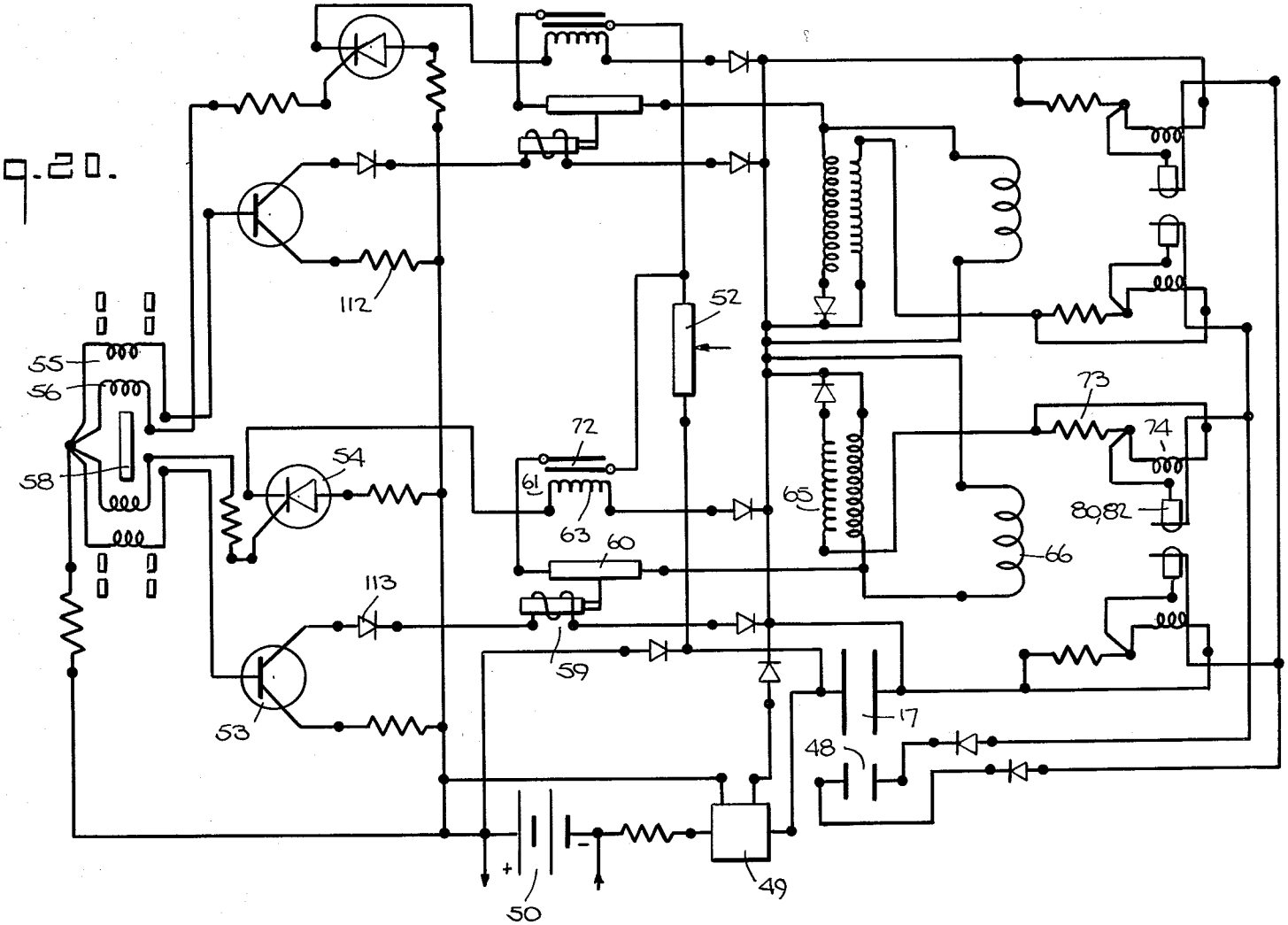
FIG. 20 is an electrical schematic, shown in detail.

Referring to FIGS. 16, 17, 20 the electrons then pass by conductive circuit through a regulator 49 that fills a battery 50 where they next enter. The battery acts as a reservoir of electrons. The electrons then go to automobile auxiliary systems, such as starter, lights, radio, etc. (not shown) and also enter an engine control center 51. Here the electricity is distributed to the pistons 13 in the correct timing intervals described above, and in the correct initial amounts.

The correct volume of electricity or amperage varies with the load conditions placed on the engine no matter what the rpm. When the throttle is opened more fuel and air is injected into the engine to be burned and this produces more force, so the magnetic fields associated with the cylinders must be strengthened calling for a stronger current to the cylinder coils and piston units which establish these fields, which will be more fully described. This initial strength comes from the battery 50 but is soon replaced by the greater amounts and speed of the ionized exhaust. The varying amperage gives control to the burning process also under various conditions.

The main function of the control center 51 is the manipulation of the magnetic fields in the cylinders. The center varies the timing and strength of these fields to match the strength of the expanding gases in the combustion chamber. To explain the flow through the system it is best to start at the MHD generator 17 and end back at the generator.

The electricity comes from the generator 17 and goes either to the battery 50 through the voltage regulator 49 or to a throttle rheostat 52, whichever the greater need is at the moment. This flow stops and starts many times each second depending on engine rpm but only is in one and the same direction. It is a rapid staccato direct current of changing frequency and intensity. The flow then is channeled to a transistor 53 and a Silicon Controlled Rectifier (SCR) 54 that are governed by their respective pickup coils 55, 56. The pickup coils are wound about u-shaped arms 69 having sensing ends 70 thereon.

The voltages induced in coils 55, 56 are produced by magnets 57, 62 imbedded in a rotating disk 58 attached to the end of a rotary valve shaft 68 with matching rpm. The magnets 57, 62 rotate past the sensing ends 70 to induce the voltage. The transistor magnet 57 is 80 degrees long and activates its pickup coil 55 20 degrees before the pistons are fully together. This will be more fully described later. The last 20 degrees 71 of the transistor magnet 57 is tapered so that the current induced in the pickup coil 55 becomes gradually weaker until it stops altogether.

This current then regulates the flow of current allowed to pass through the transistor 53. When the transistor is turned on it activates a solenoid 59 which moves a rheostat 60 to its full "on" position. As the transistor 57 magnet in the disk 58 moves to the tapered end 71 the current in the coil 55 becomes less, the transistor 53 allows less current to pass through the solenoid 59 moving the rheostat 60 toward its "off" position. This rheostat 60 controls the amount of current going to the cylinders.

The solenoid 59 takes time to get from the full "off" position to the full "on", so to compensate for this time, it is activated before the pistons are ready to fire and thus the extra 20 degree length 131 on the transistor magnet 57 in the disk 58. Since the rheostat 60 then is turning "on" ahead of time and no electrons must pass between the piston electrodes during compression, a switch 61 is placed in the circuit. This switch is in the form of a relay 61.

This relay 61 is controlled indirectly by another magnet 62 imbedded in the disk 58. This magnet 62 is 60 degrees in length and is of constant width and magnetic strength. When current is induced in this magnet's pickup coil 56 it turns on its SCR 54 which allows current to travel from the battery 50 to the coil 63 in the relay 61. This closes the relay switch 72 allowing current, now under control by the solenoid controlled rheostat 60, to pass on toward the cylinders. Before, however, this current reaches the relay 61 and rheostat 60, it has passed through the throttle rheostat 52, controlled through the throttle linkage 64.

The purpose of throttle rheostat 52 is to govern the amount of current needed under the varying load needs of the engine, again to match magentic force and expanding gas in the cylinder. The more power demanded of the engine, the more current allowed to pass on through throttle rheostat 52.

Solenoids, rheostats, and relays are chosen because of the large amounts of current used. It is also possible to substitute variable capacitors for the rheostats if the interruptable direct current is the same in function as alternating current used in conjunction with capacitors. If not rheostats will work.

After leaving the second rheostat 60 the calibrated current travels to an induction coil 65 and to a cylinder coil 66. At the induction coil 65 the voltage of the current is greatly amplified and sent on to the pistons. The cylinder coil 66 does not need this voltage force because the current has a prearranged path through the coil. However, the current in the cylinder must have enough energy to knock off the electrons in the combustion gases and that is the reason for the induction coil 65.

Figure 19:
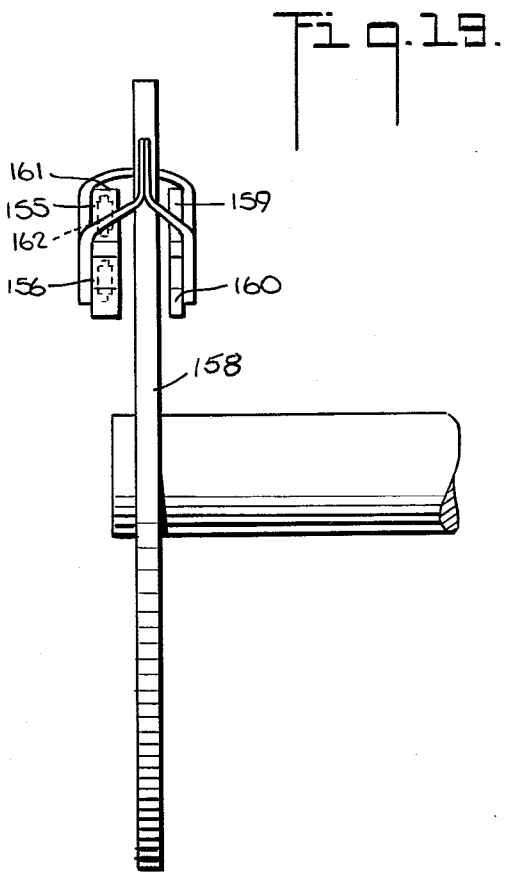
FIG. 19 is an end view of the timing disk with associated lights and photo cells.
Figure 18:
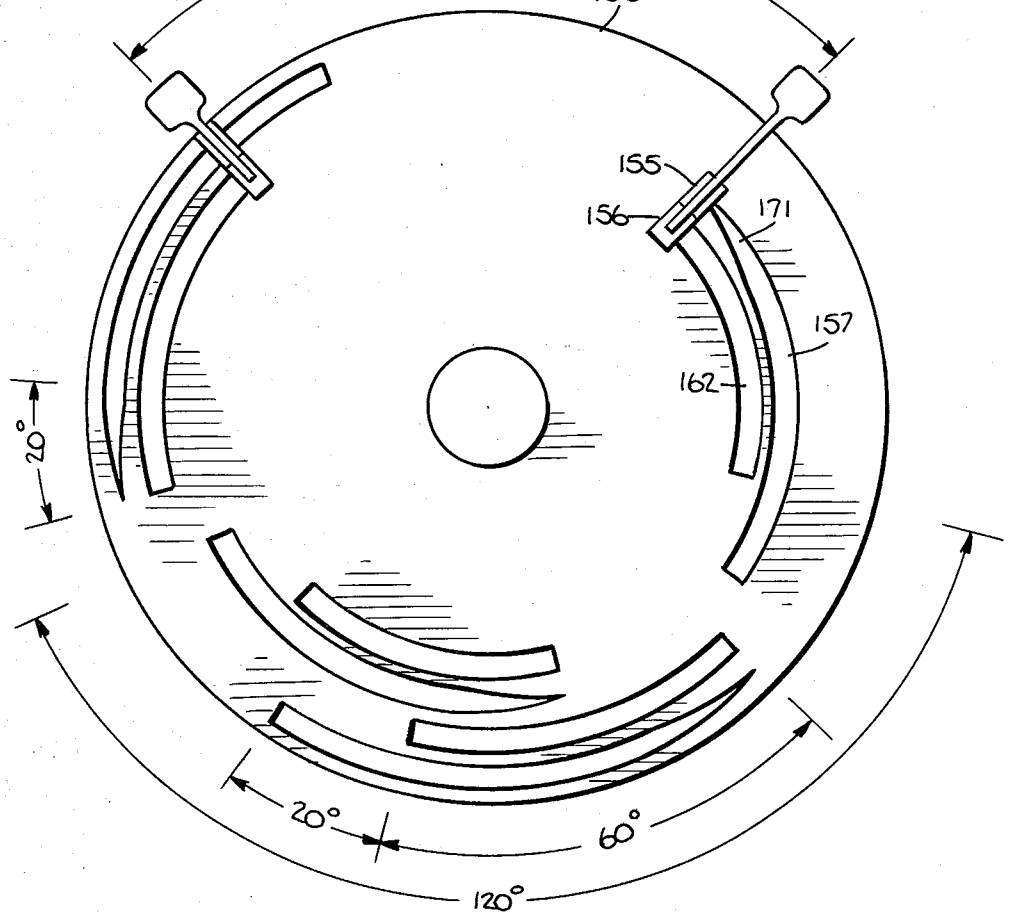
FIG. 18 is a side view of the timing disk with associated lights and photo cells in accordance with a second embodiment of this aspect of the invention.

Referring to FIGS. 18 and 19, a variable light control ignition can be used for generating the variable strength current to the SCR and transistor rather than the magnets on the disk and their pick up coils. Instead of the magnets 57, 62, a timing disk 158 has open slots 157, 162 of the same degree, width, length, position, and taper as the magnets 57, 62. Also instead of the pick up coils, 55, 56, the timing disk 158 has on one side a light source 155, 156 shining through the slots 157, 162. Actually four light sources are used. On the other side of the disk directly opposite each light source is a photo electric cell 159, 160. The light 155, 156 shines through the slot 157, 162 as the disk 158 turns and the cell generates current. As the taper 171 in the slot diminishes the light reaching the cell, the current produced becomes less and less. The light energy is directed by the shroud 161 surrounding the light bulb 162.

An advantage of this system is that no matter what the rpm of the engine the current produced by the cell 159, 160 remains relatively the same depending upon position of the slot 157, 162, provided the light source candle power remains constant. The current in the magnetic coil pick up would increase with greater rpm.

Referring additionally to FIGS. 11–15 and to FIG. 21, the current coming from the induction coil 65 passes through the electro-plate 75 and brush 76 of commutator 20, down the side of the piston arm 22 and the center post 78 in the piston face unit 102. After meeting the built in resistence 73 in the post and traveling through the magnet coil 74 the current passes to the piston electrodes 80, 82 and out through them into the combustion gases.

The electrodes 80 are placed around the *piston face* 81 to provide absolute magnetic coverage around the inner cylinder walls. The center electrode 82 is there to begin even ignition coverage as well as to present an overall magnetic field.

As the electrons then travel through the ionized combustion chamber gas and provide their magnetic field, they are prevented from straying to the cylinder walls by a nonconductive lining 25. This lining insulates the electrons from the engine and also acts as a reflector for the radiation produced by the burning process.

The cylinder lining 25 is made of glass. This material is chosen because it is hard, a nonconductor and can be readily worked to contain a cylinder coil 94. Its transparency allows the reflectiveness of the steel around it to repel the radiance of the fire in the chamber. Because of its hardness there are special break-in procedures that have to be used. The inside of the cylinders on a new engine are made with a fine roughness. The engine is then started with the cylinder coils 94 deactivated. This allows heat to build up in the chamber on the cylinder walls and the very tips of the roughness melt and form to the peculiarities of the piston rings thus seating them. The engine must then be turned off and the cylinder coils 94 connected.

The energized electrons fired into the gases, ignite the gases and free electrons from the molecule's atoms, giving the resulting ions a positive charge. At the same time, the piston magnet 79 has presented a positive charge to the piston face 81 repelling positive ions and attracting the free low energy electrons. The piston face 81 then scavenges the combustion gases of one electron per molecule even at the relatively low temperature which is the maximum allowed before nitrogen oxide formation. These electrons pass via piston face buss 99 on to the emitter 48 at the end of the MHD generator 17 and are really the electric fuel for this process.

This is an important function of this engine because without it the electrical processes would be inefficient. The current from the piston face 81 back to the generator tail emitter 48 is an important electric current in the engine. This current is rather hidden and subtle but is absolutely necessary, particularly because of the relatively low temperatures of the ionized gases.

The piston electromagnets 79 that do this scavenging have three functions. First, they must create a magnetic field with the positive side toward the combustion chamber. Second, they must emit or gather electrons through their electrodes 80, 82 shown imbedded in the magnetic core 83. Third, the electromagnets must gather electrons on their face 81 and act as an electron scrubber, gathering and removing electrons from the combustion gases at their relatively low temperatures. To do these functions the magnets have several components.

The piston face 81 is a conductor, of copper, and is separated from the piston by a dielectric 84 and has through it the electrodes 80, 82. There is more electrical resistance on this face 81 than between electrodes and its motivation is from a different source, the emitter 48, than that of the electrodes, the MHD generator 17. The face 81 is connected by a lead going through the magnet's core 83 to a ring contact 85 on the back of the unit. Ring contact 85 is insulated from the magnet core 83 by dielectric 109.

The electrodes 80, 82 and magnet's coil 74 are electrically connected through leads 86, 108 and a resistance 73 in the electrode post 78. This resistance 73 forces the electricity to travel through the coil 74.

This piston magnet unit has threads 87 on the outside and is screwed into the piston body 88 until it bottoms. At this point the face contact 85 and the coil contact 89 are pressed firmly against their corresponding contacts 90, 91 in the piston.

After passing through the combustion gases the current reaches the other piston electrodes 80, 82 and magnet 79, on through arm 22 via coil bus 98 commutator 20, and back to the generator 17. This then completes the circuit. As shown in the schematic there are several resistors 112, and diodes 113 placed in the system and these are to protect the various components against transient and incorrect voltages and to make sure the current is traveling in the right direction.

Referring to FIG. 21, the combustion ionized gases are contained by magnetic fields in two different longitudional configurations and piston end configuration working together for complete containment. The first configuration is the magnetic lines of force 92 created by the electron beams 93 as they pass through the gas in the chamber. This field circles the beam and as shown the number of beams around the outside of the cylinder creates a magnetic barrier around the cylinder. Secondly, the cylinder coil 94 circling magnetic lines of force 95 fill in the magnetic gaps that the beam lines 92 miss.

The piston lines of force come straight out from the piston. These prevent positively charge molecules from touching the piston surface as has been explained.

For emphasis the four main magnetic functions are now discussed. The first function is the MHD generator 17. This generator has two stationary magnets 40, 41 that are not electromagnets but are iron or steel. They pass magnetic lines of force through the moving ionized gas in the exhaust. The charged particles in the exhaust moving through the magnetic lines of force then produce the electric current used in the engine.

The second magnetic function is the piston magnet 79 use. It throws a positive magnetic charge toward the combustion chamber and then the lines of force bend around to the back of the piston completing the magnetic circuit. This positive force acts against the positive charge of the ions on the atoms of the gases in the chamber preventing them from touching the piston surface. This will attract electrons but their mass is so small compared to the atoms from which they originated it is of no moment or concern.

The third magnetic function is the magnetic field 92 surrounding electron beams 93 in the combustion chamber. This field's strength has upper and lower limits. It must be strong enough to prevent the ions from touching the cylinder lining and yet not so strong that it will compress the gas and increase its temperature above the 3200 degrees C. limit. The control center 51 regulates the amperage on the electron beam.

The fourth magnetic function is that provided by the cylinder lining coils 94. These fill in the gaps of the field 92 formed by the electron beams 93 and further insulate the cylinder walls 25. This magnetic field 95 is also timed and subject to variable strength which is controlled by the control center 51.

I claim:

1. An internal combustion engine comprising a plurality of cylinders having inner cylinder walls, a plurality of pistons in said cylinders having faces thereon, a magnetohydrodynamic generator, means for passing ionized exhaust gas from said cylinders through said magnetohydrodynamic generator, said magnetohydrodynamic generator passing a magnetic field through said exhaust gas, means for conducting electric current generated in said generator to said pistons, and a plurality of electrodes arranged around the face of each piston for receiving said electric current and generating electron beams through said cylinders for establishing a magnetic field in said cylinders around said inner cylinder walls to insulate the combustion gases in said cylinders from said inner walls of said cylinders.

2. An engine according to claim 1 wherein said magnetohydrodynamic generator comprises conduit means for carrying ionized exhaust gases having nonconductive portions and conductive portions, magnetic means outside said nonconductive portions for passing a magnetic field through said conduit means, and cryogenic means for supercooling said magnetic means.

3. An engine according to claim 1 comprising means for conducting electric current generated in said generator to said cylinders and coil means surrounding said inner cylinder walls for receiving said electric current and establishing a radially directed magnetic field in said cylinders.

4. An engine according to claim 1 or 3 comprising a control means electrically connected between said generator and said piston and cylinders for controlling the conduction of electrons to said pistons and to said cylinders, to control the timing and strength of the magnetic fields within said cylinders, to vary with the strength of the expanding gases in said cylinders.

5. An engine according to claim 4 in which said control means comprises rotating disc means timed to the strokes of the engine, rotating means in said rotating disc means, sensing means operably secured relative to said rotating means to generate current as said rotating means moves past said sensing means, and means regulated by said sensing means for conducting said electric current to said pistons and said cylinders.

6. An engine according to claim 5 comprising pickup coil means connected to said sensing means in which said rotating means comprises rotating magnet means secured to said rotating disc means, said sensing means induces voltage in said pickup coil means and said current conducting means is connected to said pickup coil means.

7. An engine according to claim 5 comprising light source means on one side of said rotating disc means in which said sensing means comprises photo cell means on the opposite side of said rotating disc means, and said rotating means comprises rotating slots in said disc between said light source means and said photo cell means, and said current conducting means is connected to said photo cell means.

8. An engine according to claim 5 comprising coil means secured within said cylinders for including a magnetic field having lines of force directed radially relative to said cylinders and means for conducting current from said pickup coil means to said coil means.

9. An engine according to claim 5 comprising induction coil means electrically connected between said sensing means and said electrodes to amplify the voltage conveyed to said electrodes.

10. An engine according to claim 5 in which said rotating means comprises first arc-shaped means having an arc length of 80 degrees and positioned on said rotating disc to activate first sensing means 20 degrees before said pistons reach the top of their stroke.

11. An engine according to claim 10 in which said rotating means comprises second arc-shaped means having an arc length of 60 degrees and positioned on said rotating disc to activate second sensing means 20 degrees after said first sensing means, and comprising switch means controlled by said second sensing means to switch on and off the current flowing from said first sensing means to said electrodes.

12. An engine according to claim 10 in which said first arc-shaped means tapers in the last 20 degrees of arc length to gradually reduce to zero the current induced in said first sensing means.

13. An engine according to claim 1 comprising electromagnet means secured to said piston to present a positive charge at the face of said piston and towards the combustion chamber portion of the cylinders.

14. An engine according to claim 13 comprising emitter means in said magnetohydrodynamic generator and means for conducting electrons from the face of said piston to said emitter means in said magnetohydrodynamic generator.

15. An engine according to claim 14 comprising commutator means connected to said current conducting means from said magnetohydrodynamic generator, bus means connected to said commutator means for conducting electric current from the face of said piston, and means for sealing said cylinder associated with said commutator means.

16. An engine according to claim 2 comprising vacuum container means surrounding and supporting said conduit means to insulate said conduit means from other portions of the generator, container means for sealing said cryogenic means with respect to said magnetic means, and means for limiting the flow of kinetic energy to said cryogenic container means.

17. An engine according to claim 2 comprising electron emitter means positioned on said conduit means to attract the ionized exhaust gas through said conduit means.

18. An engine according to claim 4 wherein the timing and strength of said magnetic fields are controlled by said control means to keep the temperature of the combustion gases within the cylinder below 3200 degrees C.

19. An engine according to claim 2 wherein said conduit means comprises pipe means comprising opposed conductive plates and opposed non-conductive plates substantial at right angles to the magnetic field.

20. An engine according to claim 19 comprising means connected to said conductive plates for conducting electricity to said pistons.

21. An engine according to claim 2 in which said magnetic means pass a magnetic field substantially at right angle to the flow of ionized exhaust gases through said magnetohydrodynamic generator.

22. An engine according to claim 1 comprising rotary valve means having an intake port, a first exhaust port and a second exhaust port wherein said engine executes a six stroke combustion process.

23. An engine according to claim 1 comprising an intake and primary exhaust manifold for passing partially combusted gas from one cylinder to a second cylinder together with intake gas, and in which said means for passing said ionized gas to said magnetohydrodynamic generator comprises a secondary exhaust manifold, said manifolds having a dialectric lining to inhibit deionization of said gases.

24. An engine according to claim 1 comprising circular magnet means embedded in said cylinder walls perpendicular to said electron beams and means for conducting electric current generated in said generator to said circular magnet means to generate a magnetic field to fill gaps between the fields formed by said electron beams.

25. An internal combustion engine comprising a plurality of cylinders having inner cylinder walls, a plurality of pistons in said cylinders having faces thereon, a magnetohydrodynamic generator, means for passing ionized exhaust gas from said cylinders through said magnetohydrodynamic generator, said magnetohydrodynamic generator passing a magnetic field through said exhaust gas, means for conducting electric current generated in said generator to said pistons, and magnetic field means on said pistons and said cylinder walls for establishing a magnetic field in said cylinders around said inner cylinder walls to insulate the combustion gases in said cylinders from said inner walls of said cylinders, said cylinder walls having a non-conductive lining.

26. An engine according to claim 25 in which said cylinder walls have a non-conductive lining.

27. An engine according to claim 26 in which said non-conductive lining is a glass lining.

28. An engine according to claim 26 in which cylinder coil means for inducing a radially directed magnetic field in said cylinders are embedded in said nonconductive lining.

29. An internal combustion engine comprising a plurality of cylinders having inner cylinder walls, a plurality of pistons in said cylinders having faces thereon, a magnetohydrodynamic generator, means for passing ionized exhaust gas from said cylinders through said magnetohydrodynamic generator, said magnetohydrodynamic generator passing a magnetic field through said exhaust gas, means for conducting electric current generated in said generator to said pistons, magnetic field means on said pistons and said cylinder walls for establishing a magnetic field in said cylinders around said cylinder walls to insulate the combustion gases in said cylinders from said inner walls of said cylinders, and a control means electrically connected between said generator and said piston and cylinders for controlling the conduction of electrons to said pistons and to said cylinders, to control the timing and strength of the magnetic fields within said cylinders, to vary the strength of the expanding gases in said cylinders, said control means comprises rotating disc means timed to the strokes of the engine, rotating means in said rotating disc means, sensing means operably secured relative to said rotating means to generate current as said rotating means moves past sensing means, and means regulated by said sensing means for conducting said electric current to said piston and cylinder magnetic field means, said control means further comprising light source means on one side of said rotating disc means, and said sensing means comprising photo cell means on the opposite side of said rotating disc means, and said rotating means comprises rotating slots in said disc between said light source means and said photo cell means, and said current conducting means is connected to said photo cell means.

30. An internal combustion engine comprising a plurality of cylinders having inner cylinder walls, a plurality of pistons in said cylinders having faces thereon, a magnetohydrodynamic generator, means for passing ionized exhaust gas from said cylinders through said magnetohydrodynamic generator, said magnetohydrodynamic generator passing a magnetic field through said exhaust gas, means for conducting electric current generated in said generator to said pistons, and magnetic field means on said pistons and said cylinder walls for establishing a magnetic field in said cylinders around said cylinder walls to insulate the combustion gases in said cylinders from said inner walls of said cylinders, a control means electrically connected between said generator and said piston and cylinders for controlling the conduction of electrons to said pistons and to said cylinders, to control the timing and strength of the magnetic fields within said cylinders, to vary the strength of the expanding gases in said cylinders, said control means comprises rotating disc means timed to the strokes of the engine, rotating means in said rotating disc means, sensing means operably secured relative to said rotating means to generate current as said rotating means moves past said sensing means, and means regulated by said sensing means for conducting said electric current to said piston and cylinder magnetic field means, said rotating means comprises first arc-shaped means having an arc length of 80 degrees and positioned on said rotating disc to activate first sensing means 20 degrees before said pistons reach the top of their stroke.

31. An engine according to claim 30 in which said rotating means comprises second arc-shaped means having an arc length of 60 degrees and positioned on said rotating disc to activate second sensing means 20 degrees after said first sensing means, and comprising switch means controlled by said second sensing means to switch on and off the current flowing from said first sensing means to said magnetic field means.

32. An engine according to claim 30 or 31 in which said first arc-shaped means tapers in the last 20 degrees of arc length to gradually reduce to zero the current induced in said first sensing means.

33. An engine according to claims 1, 2, 13, 3, 24 or 25 in which said plurality of cylinders and said plurality of pistons are arranged in spaced opposed relationship, comprising rotary valve means for opening and closing said cylinders for intaking fuel and exhausting combusted gases.

34. An engine according to claim 33 in which the first exhaust port of the rotary valve associated with a first pair of spaced-opposed cylinders is arranged with the intake port of the rotary valve associated with a second pair of spaced-opposed cylinders, to direct the exhaust gases from said first cylinders to the intake of said second cylinders during an exhaust stroke of said six stroke process.

35. An engine according to claim 1, 3 or 25 comprising emitter means in said magnetothydrodynamic generator, a conductive piston face electrically connected to said emitter means, said electrodes being arranged around said piston piston face and insulated from it, electromagnetic coil means supported by said piston and electrically connected between said electrodes and said magnetohydrodynamic generator.

* * * * *